US009803323B2

(12) United States Patent
Hofstaetter

(10) Patent No.: US 9,803,323 B2
(45) Date of Patent: Oct. 31, 2017

(54) TRACK TAMPING MACHINE HAVING SEPARATELY STIMULATED VIBRATING TAMPING PICKS

(71) Applicant: PLASSER & THEURER, EXPORT VON BAHNBAUMASCHINEN, GESELLSCHAFT M.B.H., Vienna (AT)

(72) Inventor: Josef Hofstaetter, Puchenau (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 133 days.

(21) Appl. No.: 14/437,516

(22) PCT Filed: Sep. 27, 2013

(86) PCT No.: PCT/EP2013/002914
§ 371 (c)(1),
(2) Date: Apr. 22, 2015

(87) PCT Pub. No.: WO2014/063770
PCT Pub. Date: May 1, 2014

(65) Prior Publication Data

US 2015/0267355 A1 Sep. 24, 2015

(30) Foreign Application Priority Data

Oct. 24, 2012 (AT) ..... A 1150/2012

(51) Int. Cl.
*E01B 27/16* (2006.01)

(52) U.S. Cl.
CPC ..... *E01B 27/16* (2013.01)

(58) Field of Classification Search
CPC ..... E01B 27/00; E01B 27/12; E01B 27/13; E01B 27/16; E01B 27/17; E01B 27/18; E01B 27/20
See application file for complete search history.

(56) References Cited

U.S. PATENT DOCUMENTS 5,533,455 A * 7/1996 Theurer ..... E01B 27/16 62/155

FOREIGN PATENT DOCUMENTS

| | | |
|---|---|---|
| DE | 3248172 A1 | 6/1984 |
| EP | 0564433 A1 | 10/1993 |
| EP | 0698687 A1 | 2/1996 |

* cited by examiner

*Primary Examiner* — R. J. McCarry, Jr.
(74) *Attorney, Agent, or Firm* — Laurence A. Greenberg; Werner H. Stemer; Ralph E. Locher

(57) ABSTRACT

A tamping unit of a machine for simultaneously tamping at least two sleepers of a track, positioned one following the other with regard to a longitudinal direction of the machine, includes inner tamping tines provided for simultaneous immersion into the same sleeper crib and, arranged at either end, a respective outer tamping tine. Each tamping lever mounted on an assembly frame for pivoting about a pivot axis is connected to a squeeze drive. Each squeeze drive is mounted on a common eccentric shaft having an eccentricity with respect to an axis of rotation. The eccentricity causing vibrations of the inner tamping tine is configured differently as compared to the eccentricity causing vibrations of the outer tamping tine.

3 Claims, 1 Drawing Sheet

FIG. 1
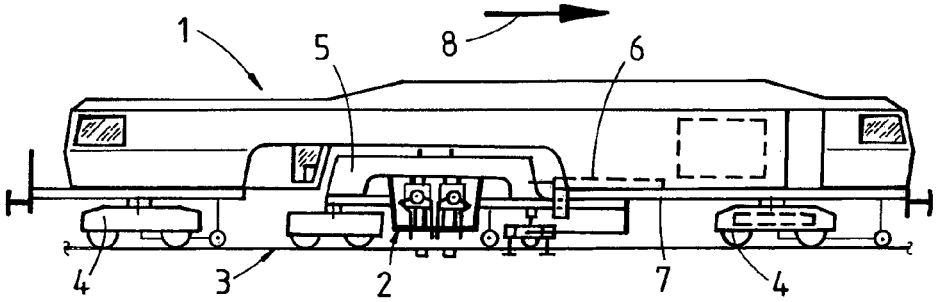
FIG. 2
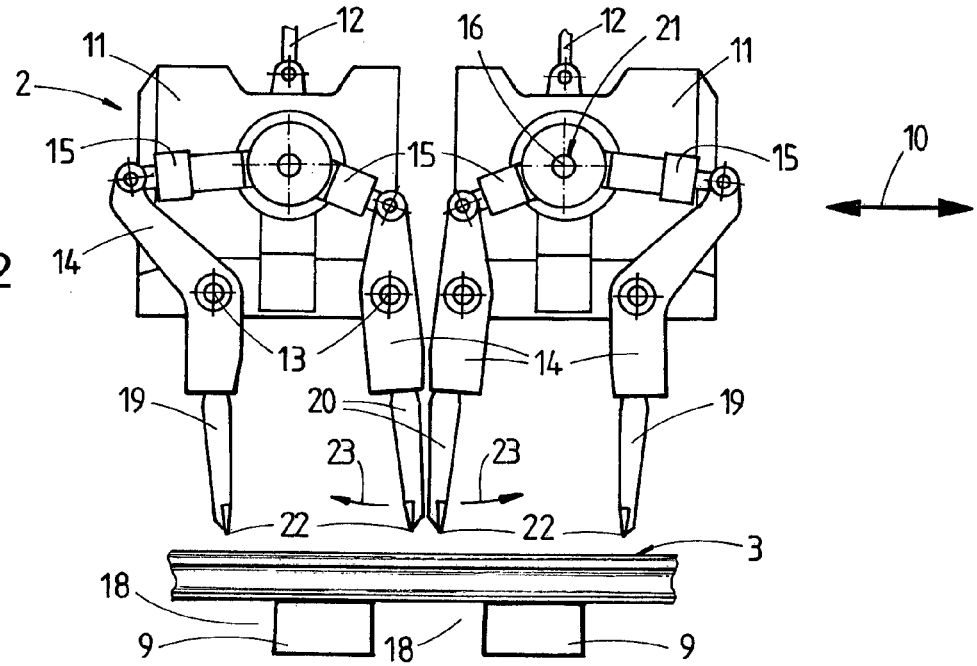
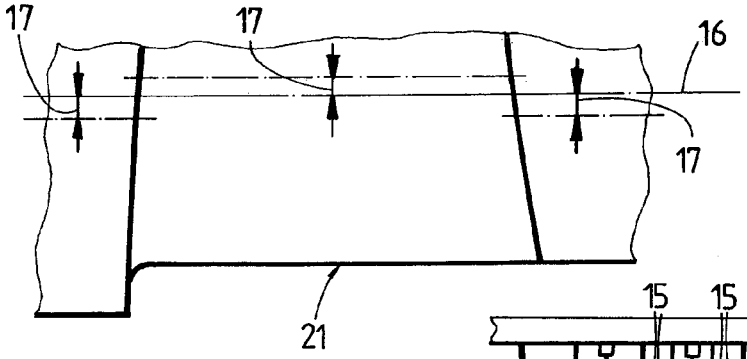
FIG. 3
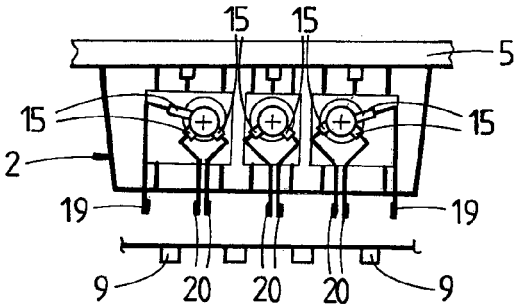
FIG. 4

TRACK TAMPING MACHINE HAVING SEPARATELY STIMULATED VIBRATING TAMPING PICKS

BACKGROUND OF THE INVENTION

Field of the Invention

The invention relates to a machine having a tamping unit for simultaneously tamping at least two sleepers of a track, positioned one following the other with regard to a longitudinal direction of the machine.

A machine of this type is known, for example, from EP 0 564 433. Both tamping units provided for tamping a track can be lowered jointly for simultaneously tamping two adjacent sleepers. If a track obstacle is present, it is also possible to employ only one of the two tamping units, as required, in order to be able to tamp at least a single sleeper in this special situation.

BRIEF SUMMARY OF THE INVENTION

It is the object of the present invention to create a machine of the type mentioned at the beginning with which a further improvement of the tamping quality can be attained.

According to the invention, this object is achieved with a machine of the specified type in that the eccentricity causing vibrations of the inner tamping tine is configured differently as compared to the eccentricity causing vibrations of the outer tamping tine.

With these features, it is possible to achieve a uniform amplitude in the region of the lower tine ends of outer and inner tamping tines despite a different length of the tamping levers. Thus, a more even compaction of the ballast adjoining both sleeper sides and therefore also a more homogenous sleeper support can be attained.

Additional advantages of the invention become apparent from the dependent claim and the drawing description.

BRIEF DESCRIPTION OF THE SEVERAL VIEWS OF THE DRAWING

The invention will be described in more detail below with reference to an embodiment represented in the drawing in which FIG. 1 shows a side view of a machine for tamping a track, FIG. 2 shows an enlarged side view of a tamping unit, FIG. 3 shows an enlarged representation of an eccentric shaft of the tamping unit, and FIG. 4 shows a simplified view of a four-sleeper tamping unit.

DESCRIPTION OF THE INVENTION

A machine, 1, shown in FIG. 1, has a tamping unit 2 for tamping a track 3. In order to increase the efficiency of the machine 1, a satellite frame 5 arranged between on-track undercarriages 4 is displaceable by means of a drive 6 relative to a machine frame 7. Thus, the latter can be moved continuously in the working direction, indicated by arrow 8, during the tamping of the track 3.

As can be seen in FIG. 2, the tamping unit 2—designed for simultaneously tamping two adjacent sleepers 9—is composed of two assembly frames 11 arranged one following the other in a longitudinal direction 10 of the machine, each assembly frame 11 being connected to a separate drive 12 for vertical adjustment independently of one another.

Each tamping lever 14, mounted for pivoting about a pivot axis 13 on an assembly frame 11, is connected to a squeeze drive 15. The squeeze drives 15 of each assembly frame 11 are mounted in each case on a common eccentric shaft 21 having an eccentricity 17 with regard to an axis of rotation 16 (see FIG. 3).

Arranged at either end of the tamping unit 2, with regard to the longitudinal direction 10 of the machine, is a respective outer tamping tine 19 which is connected to a tamping lever 14 and provided for immersion into a sleeper crib 18 by itself. Provided for common immersion into the same sleeper crib 18 are two inner tamping tines 20 arranged one following the other in the longitudinal direction 10 of the machine, each connected to a tamping lever 14.

As can be seen clearly in FIG. 3, the eccentric shaft 21 has different eccentricities 17 offset with respect to the axis of rotation 16. These are configured such that the eccentricity 17 acting on the inner tamping tine 20—in the form of vibrations via the corresponding squeeze drive 15 and the adjoining tamping lever 14—is designed differently as compared to the eccentricity 17 causing vibrations of the outer tamping tine 19. The squeeze drive 15 generating a squeezing motion 23 of the inner tamping tine 20 is mounted in each case on the central eccentricity 17 which is smaller than the adjoining eccentricities 17. Mounted on the latter are the squeeze drives 15 acting upon the outer tamping tines 19. Thus it is possible to achieve an equal amplitude of all tamping tine tips 22.

In a variant of the invention, it is also possible to use only a single, common assembly frame instead of two independently vertically adjustable assembly frames 11. Likewise, a tamping unit 2—shown in a simplified way in FIG. 4—for simultaneously tamping four adjacent sleepers 9 can be designed, according to the invention, with different eccentricities for the eccentric shaft 21. In this, the squeeze drives 15 acting upon the inner tamping tines 20 are in each case mounted on the smaller eccentricity, while the squeeze drives 15 acting upon the outer tamping tines 19 are mounted on the bigger eccentricity. By analogy, this is naturally also applicable to tamping units which are designed for simultaneously tamping an even greater number of sleepers.

The invention claimed is:

1. A machine, comprising:

a tamping unit for simultaneously tamping at least two sleepers of a track, wherein the sleepers are positioned one following the other with regard to a longitudinal direction of the machine, said tamping unit having:

a plurality of tamping levers each mounted for pivoting about a pivot axis on an assembly frame and connected to a squeeze drive;

two inner tamping tines provided for simultaneous immersion into a common sleeper crib, said two inner tamping tines being disposed following one another in the longitudinal direction of the machine and being connected to respective said tamping levers;

outer tamping tines respectively disposed at either end of said tamping unit with regard to the longitudinal direction of the machine, each said outer tamping tine being connected to a respective said tamping lever and configured for immersion into a respective sleeper crib by itself; and each squeeze drive being mounted on a common eccentric shaft having an eccentricity with respect to an axis of rotation, and wherein said eccentricity causing vibrations of said inner tamping tine is configured differently from said eccentricity causing vibrations of said outer tamping tine.

2. The machine according to claim 1, wherein said eccentricity for said inner tamping tine is smaller than said eccentricity for said outer tamping tine.

3. A ballast tamping machine, comprising:

a tamping unit for simultaneously tamping at least two sleepers of a track, wherein the sleepers are positioned one following the other with regard to a longitudinal direction of the machine, said tamping unit having:

a plurality of tamping levers each mounted for pivoting about a pivot axis on an assembly frame and connected to a squeeze drive;

two inner tamping tines provided for simultaneous immersion into a common sleeper crib, said two inner tamping tines being disposed following one another in the longitudinal direction of the machine and being connected to respective said tamping levers;

outer tamping tines respectively disposed at either end of said tamping unit with regard to the longitudinal direction of the machine, each said outer tamping tine being connected to a respective said tamping lever and configured for immersion into a respective sleeper crib by itself; and an eccentric shaft having an eccentricity with respect to an axis of rotation, said eccentricity including a relatively smaller eccentricity and a relatively greater eccentricity, said eccentric shaft being mounted to drive said tamping tines to vibrate via said tamping levers, and wherein said eccentricity causing vibrations of said inner tamping tine is smaller than said eccentricity causing vibrations of said outer tamping tine.

* * * * *